US007431600B2

(12) United States Patent
Kozak et al.

(10) Patent No.: US 7,431,600 B2
(45) Date of Patent: Oct. 7, 2008

(54) RJ STYLE CONNECTOR TO ELIMINATE CABLE ELECTROSTATIC DISCHARGE EVENTS

(75) Inventors: Frederic Michael Kozak, Raleigh, NC (US); Kevin Franklin Casey, Cary, NC (US); Milton Palmer Hilliard, Hillsborough, NC (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 11/669,330

(22) Filed: Jan. 31, 2007

(65) Prior Publication Data

US 2008/0182437 A1 Jul. 31, 2008

(51) Int. Cl.
*H01R 13/53* (2006.01)

(52) U.S. Cl. ..... 439/181; 439/676; 439/924.1; 439/607

(58) Field of Classification Search ..... 439/181, 439/676, 924.1, 607, 609
See application file for complete search history.

(56) References Cited

U.S. PATENT DOCUMENTS

| | | | | |
|---|---|---|---|---|
| 5,080,613 | A * | 1/1992 | Orui et al. | 439/660 |
| 5,169,346 | A * | 12/1992 | Johnston | 439/676 |
| 5,342,220 | A * | 8/1994 | Kodama | 439/607 |
| 6,468,097 | B1 * | 10/2002 | Bernstein et al. | 439/181 |
| 6,790,097 | B1 * | 9/2004 | Edwards et al. | 439/676 |

* cited by examiner

*Primary Examiner*—Javaid Nasri
(74) *Attorney, Agent, or Firm*—Peggy A. Su

(57) ABSTRACT

Methods and apparatus for discharging cables that are to be coupled to a connector are disclosed. According to one aspect of the present invention, an apparatus includes at least one signal contact, a housing, and a ground arrangement. The housing defines a receptacle configured to receive a part of a cable assembly. The signal contact is disposed within the receptacle, and is configured to contact a first contact of the cable assembly when the cable assembly is received in the receptacle such that a signal may pass between the signal contact and the first contact. The ground arrangement is at least partially disposed on the housing, and is arranged to contact and to ground the first contact before the first contact contacts the at least one signal contact.

6 Claims, 5 Drawing Sheets

RJ STYLE CONNECTOR TO ELIMINATE CABLE ELECTROSTATIC DISCHARGE EVENTS

BACKGROUND OF THE INVENTION

The connection of cables to ports on electronic equipment, e.g., network equipment, often causes electrostatic discharge (ESD) events. An ESD event is generally a flow of an electric current from one potential to another that may damage electronic equipment. To prevent ESD events, persons handling cables may take precautions such as wearing conductive wrist straps and working in electrostatic protective areas. However, even with the proper handling of cables, electron accumulation often occurs on the cables and, hence, ESD events occur when the cables are plugged into ports on electronic equipment.

BRIEF DESCRIPTION OF THE DRAWINGS

The invention may best be understood by reference to the following description taken in conjunction with the accompanying drawings in which.

DESCRIPTION OF EXAMPLE EMBODIMENTS

General Overview

In one embodiment, an apparatus includes at least one signal contact, a housing, and a ground arrangement. The housing defines a receptacle configured to receive a part of a cable assembly. The signal contact is disposed within the receptacle, and is configured to contact a first contact of the cable assembly when the cable assembly is received in the receptacle such that a signal may pass between the signal contact and the first contact. The ground arrangement is at least partially disposed on the housing, and is arranged to contact and to ground the first contact before the first contact contacts the at least one signal contact.

DESCRIPTION

RJ connectors are often used to connect or otherwise terminate cables that are used in telecommunications applications. RJ style connectors may include, but are not limited to, RJ-11, RJ-21, and RJ-45 connectors. A modified RJ connector or an overall RJ connector assembly that includes ground conductors that make contact with the contacts of a cable prior to the cable being seated within the connector assembly, i.e., such that the contacts of the cable are interfaced with contacts of the connector assembly. When a cable makes contact with the ground conductors of the connector assembly, substantially any electron build-up in the cable may be discharged through the ground conductors. That is, the ground conductors provide a grounding path for any charge that is accumulated in the cable that would otherwise potentially cause an electrostatic discharge (ESD) event with respect to the contacts of the connector assembly. Hence, when the cable or, more specifically, the contacts of the cable come into contact with the contacts of the connector assembly, the risk of an ESD event occurring is relatively low.

Figure 1:
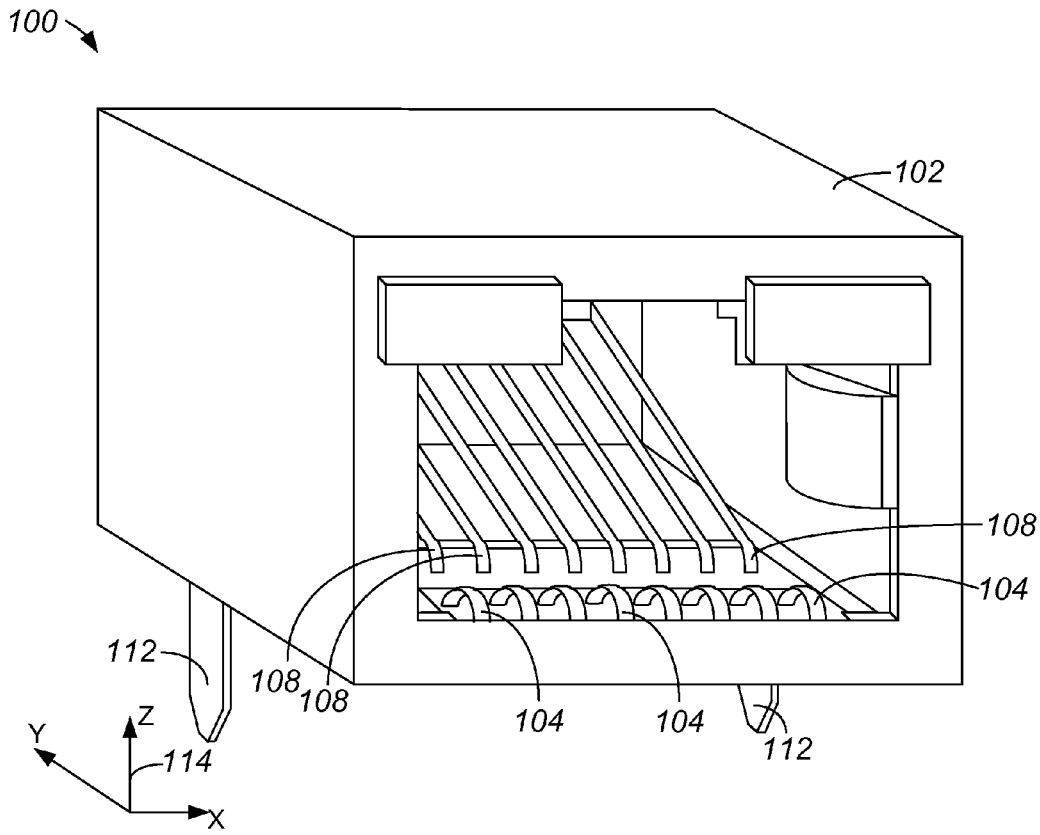
FIG. 1 is a diagrammatic representation of a modified RJ connector in accordance with an embodiment of the present invention.

With reference to FIG. 1, one example of an RJ connector with ground conductors will be described in accordance with an embodiment of the present invention. An RJ connector 100 includes a housing 102 and electrical contacts 108. Housing 102 is generally a shell into which a cable (not shown) may be received and held. That is, housing 102 defines a receptacle or a receiver for a cable (not shown). When a cable (not shown) is held within housing 102, electrical contacts of the cable are positioned in contact with a plurality of contacts 108, e.g., an array of contacts, disposed in housing 102 such that streams or signals may flow between the electrical contacts of the cable and contacts 108. Typically, contacts 108 are communicably coupled to elements or components of an electronic device for which connector 100 serves as a port. By way of example, contacts 108 may be coupled to wires and/or leads which connect to devices on a printed circuit board or a line card on which connector 100 is supported.

Connector 100 also includes ground conductors 104 which are positioned at an entrance to connector 100 or, more specifically, the entrance to a receptacle defined by housing 102. In other words, ground conductors 104 are positioned such that a electrical contacts of a cable (not shown) that is being plugged into connector 100 will come into contact with ground conductors 104 prior to coming into contact with contacts 108. In one embodiment, ground conductors 104 are positioned at a front edge of housing 102 and sized such that connector 100 has substantially the same footprint as a standard connector 100. By way of example, if connector 100 is an RJ-11 connector, then connector 100 has substantially the same external dimensions as a standard RJ-11 connector.

Ground conductors 104, or ESD contacts, may be metallized and relatively flexible. By way of example, ground conductors 104 may be arranged such that when a force is imparted on ground conductors 104 in a z-direction 114 by electrical contacts of a cable (not shown), ground conductors 104 may slightly deform, and provide a restraining force in z-direction 114 that substantially counteracts the force applied by the cable. The flexibility of ground conductors 104 effectively ensures that ground conductors 104 will contact recessed electrical contacts of a cable (not shown) during the insertion of the cable into housing 100, and allow for the cable to be seated within housing 100 once insertion is complete.

Ground conductors 104 are coupled to a chassis (not shown) via ground pins 112. That is, ground conductors 104 are in communication with a grounding shield (not shown) of connector 100 that is coupled to a grounded chassis (not shown) through pins 112. Such a shield (not shown) is effectively referenced to a chassis (not shown). A path defined from ground conductors 104 through the shield (not shown) to the chassis (not shown) is effectively a grounding path that allows any electrical discharge to end at a grounded chassis. As will be appreciated by those skilled in the art, electrical charge may be stored up due to handling and dragging of a cable assembly (not shown) that is to be plugged into connector 100. As such, the path to ground allows electrical discharge to substantially be controlled by reducing the likelihood that any electrical discharge will occur through contacts 108.

Figure 2A:
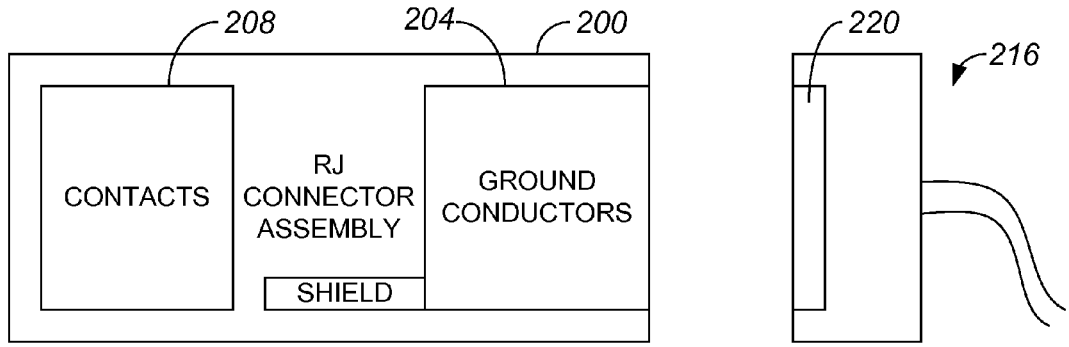
FIG. 2A is a block diagram representation of an RJ connector assembly into which a cable may be plugged in accordance with an embodiment of the present invention.
Figure 2B:
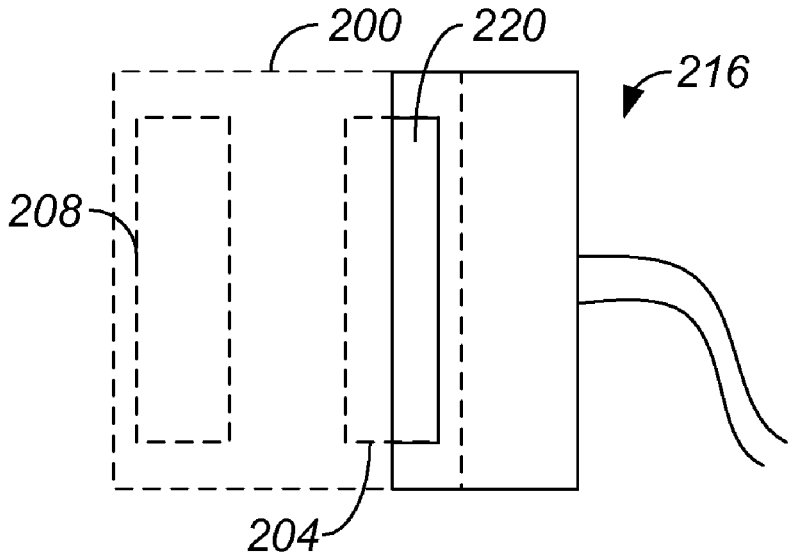
FIG. 2B is a block diagram representation of a cable in contact with ground conductors in an RJ connector assembly, e.g., ground conductors 204 of RJ connector assembly 200 of FIG. 2A, in accordance with an embodiment of the present invention.

FIG. 2A is a block diagram of a cable and a connector assembly that includes ground conductors in accordance with an embodiment of the present invention. A connector assembly 200 is arranged to receive a cable 216 that includes contacts 220. Connector assembly 200 includes ground conductors 204 that are arranged to allow for an ESD event to occur, and contacts 208 that are arranged to substantially engage with contacts 220 when a head-end of cable 216 is positioned within assembly 220. When an insertion of cable 216 into connector assembly 200 begins, contacts 220 of cable 216 come into contact with ground conductors 204 of connector assembly 200, as shown in FIG. 2B. As ground conductors 204 provide a controlled return path to a grounded chassis, electrical charge that is built up in cable 216 may be discharged to ground upon contact of contacts 220 with ground conductors 204.

Figure 2C:
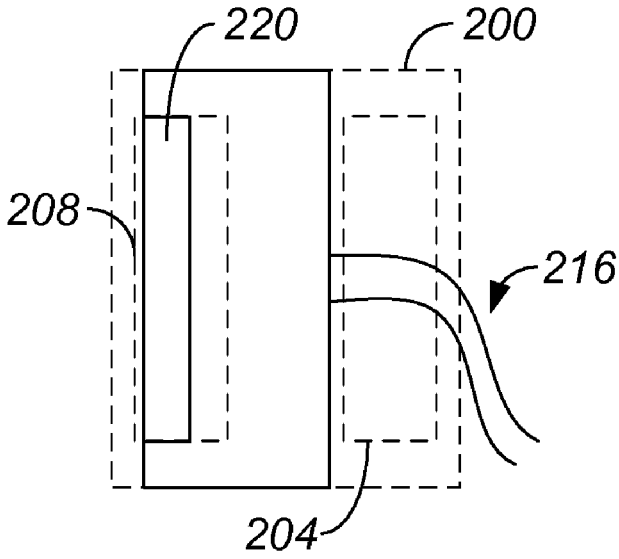
FIG. 2C is a block diagram representation of a cable seated in an RJ connector assembly, e.g., RJ connector assembly 200 of FIG. 2A, in accordance with an embodiment of the present invention.

Upon further insertion of cable 216 into connector assembly 200, when contacts 220 of cable 216 engage with contacts 208 of connector assembly 220, an ESD event is not likely to occur, as substantially any stored charge has already been discharged to ground by ground conductors 204. Hence, as shown in FIG. 2C, when cable 216 is inserted in connector assembly 200, the likelihood of an ESD event occurring is relatively low.

Figure 3:
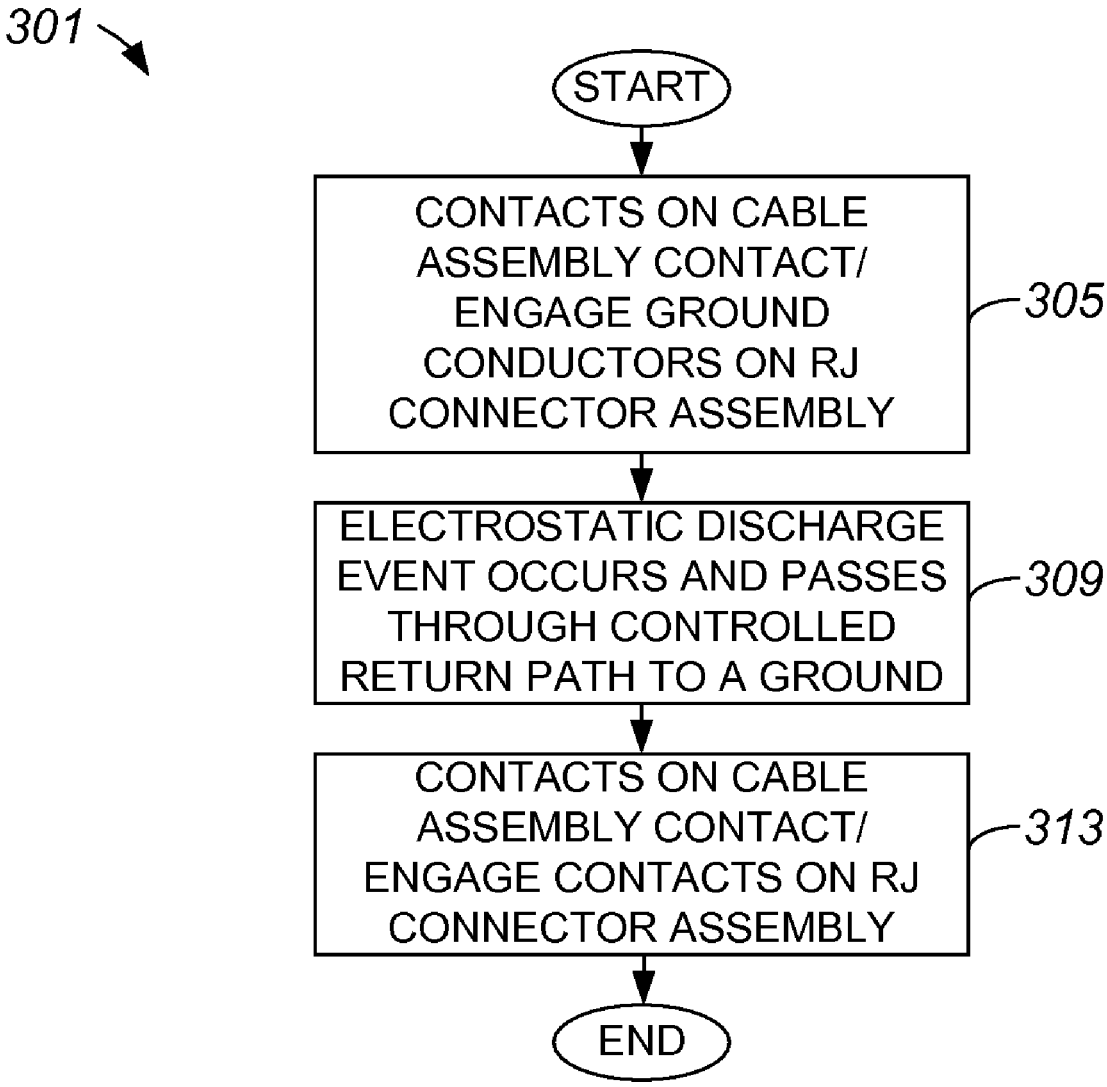
FIG. 3 is a process flow diagram which illustrates one method of plugging a cable into an RJ connector assembly that includes ground conductors in accordance with an embodiment of the present invention.

Referring next to FIG. 3, the steps associated with one method of inserting a cable into a connector assembly that includes ground conductors will be described in accordance with an embodiment of the present invention. A process 301 of inserting a cable into a connector assembly begins at step 305 in which contacts on a cable assembly contact ground conductors on the connector assembly. Once the contacts on the cable assembly come into contact with the ground conductors on the connector assembly, if there is stored up electrical charge on the cable assembly, an ESD event may occur such that the electrical charge is discharged through a controlled return path to a ground of a chassis in step 309.

After the ESD event, if any, occurs, the contacts on the cable assembly come into contact with the contacts on the connector assembly in step 313. In one embodiment, when the contacts on the cable assembly contact or engage the contacts on the connector assembly, the connector assembly is effectively mated with the cable assembly. The process of inserting the cable assembly into the connector assembly is completed when the contacts on the cable assembly contact the contacts on the connector assembly.

In general, an RJ connector assembly has been described as a modified connector, e.g., a modified connector port or jack, that substantially integrally includes ground conductors. A modified RJ connector generally has substantially the same footprint as a standard RJ connector. Hence, a modified RJ connector with ground conductors may be used to retrofit substantially any equipment which uses a standard, e.g., shielded, RJ connector. As such, the use of a modified RJ connector does not utilize more space within the equipment than used by a standard connector.

In lieu of being a modified RJ connector, however, an RJ connector assembly may include a standard RJ connector that is interfaced with an adapter that includes ground conductors. That is, an RJ connector assembly may effectively be formed by augmenting a standard RJ connector with an adapter. Such an adapter may be used to provide a standard RJ connector, as for example a standard RJ connector that is already installed in electronic equipment, with ESD protection.

Figure 4A:
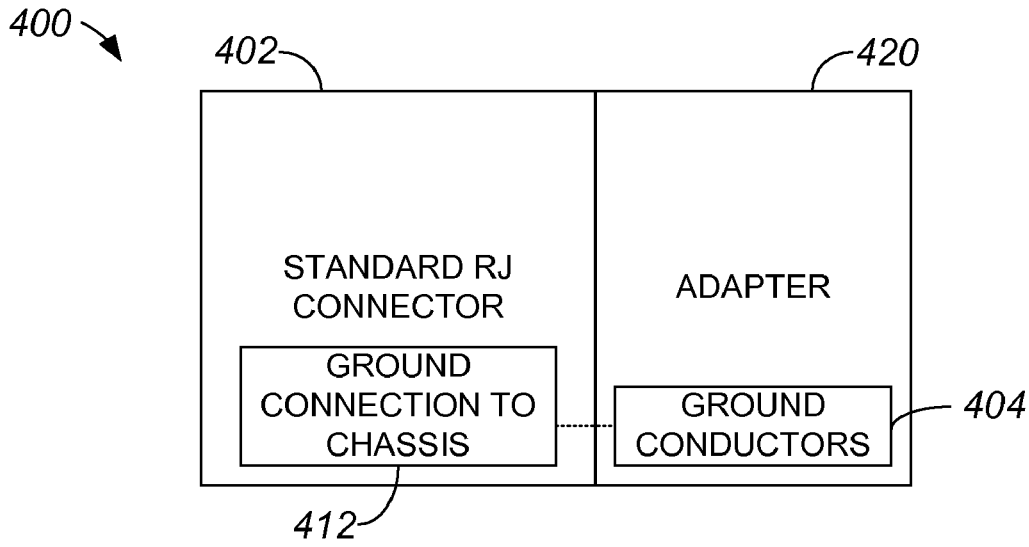
FIG. 4A is a block diagram representation of an RJ connector assembly which includes an adapter with ground conductors in accordance with an embodiment of the present invention.

FIG. 4A is a block diagram representation of an RJ connector assembly which is comprised of a standard RJ connector and an adapter with ground conductors in accordance with an embodiment of the present invention. A connector assembly 400 includes a standard connector 402, e.g., an RJ connector without integral ground conductors, and an adapter 420 that includes ground conductors 404. When standard connector 402 and adapter 420 are coupled or otherwise interfaced, ground conductors 404 are coupled to a ground connection 412 in standard connector 402. As ground connection 412 is coupled to a grounded chassis (not shown), ground conductors 404 are effectively coupled to the grounded chassis through ground connection 412. Hence, when a cable assembly (not shown) comes into contact with ground conductors 404, any charges stored up in the cable assembly may be discharged to the grounded chassis (not shown).

Figure 4B:
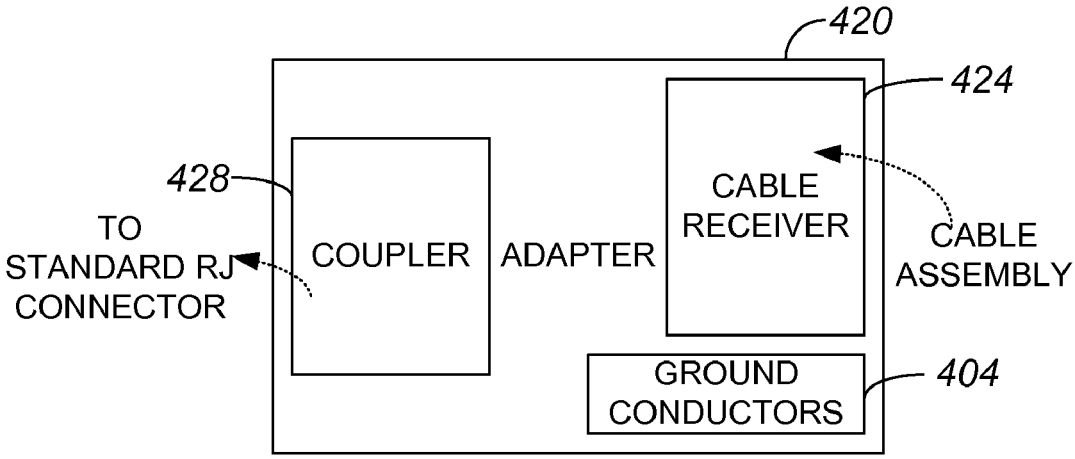
FIG. 4B is a block diagram representation of an adapter with ground conductors, e.g., adapter 420 of FIG. 4A in accordance with an embodiment of the present invention.

Adapter 420 generally includes a receptacle that allows a cable assembly (not shown) to be passed therethrough, and a coupler that allows adapter 420 to be coupled to standard connector 402. FIG. 4B is a block diagram representation of adapter 420 in accordance with an embodiment of the present invention. In addition to ground conductors 404, adapter 420 includes a cable receiver 424 that is arranged to receive a cable assembly. Cable receiver 424 may be, in one embodiment, an opening in adapter 420 that allows a cable to be inserted into standard connector 402 through cable receiver 424. Adapter 420 also includes a coupler 428 that allows adapter 420 to be coupled to standard connector 402. The configuration of coupler 428 may vary widely. By way of example, coupler 428 may effectively be a female end that is arranged to be coupled to standard connector 402, which may serve as a male end. Alternatively, coupler 428 may be an adhesive that is arranged to adhere to standard connector 402.

Figure 5:
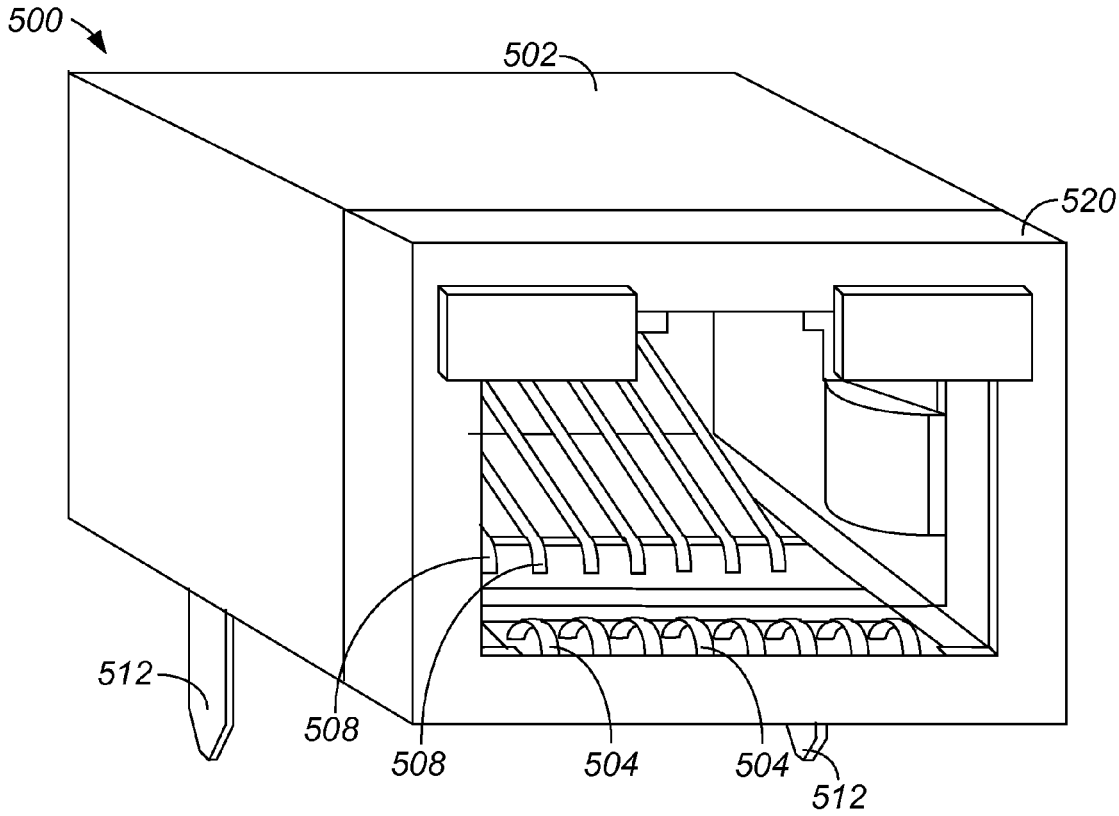
FIG. 5 is a diagrammatic representation of an RJ connector assembly that includes an adapter with ground conductors in accordance with an embodiment of the present invention.

With reference to FIG. 5, one embodiment of an RJ connector assembly which includes an adapter will be described. A connector assembly 500 includes a standard connector 502 which includes contacts 508 and ground pins 512 that allow a shield (not shown) in standard connector 502 to be coupled to a grounded chassis (not shown). An adapter 520 of connector assembly 500 includes ground connectors 504, and is arranged to be interfaced with standard connector 502. Adapter 520 is configured to receive a cable (not shown) such that electrical contacts of the cable come into contact with ground conductors 504 prior to coming into contact with contacts 508.

Although only a few embodiments of the present invention have been described, it should be understood that the present invention may be embodied in many other specific forms without departing from the spirit or the scope of the present invention. By way of example, the use of ground conductors to effectively prevent ESD events has been described as suitable in RJ style connectors. However, the use of ground conductors is not limited to use with RJ style connectors. Other connectors, such as other modular connectors that are used in telecommunications applications, may also utilize ground conductors. Such modular connectors may include, but are not limited to including, cable jacks such as CAT style cable jacks.

The number of grounding conductors in a connector assembly may vary widely depending upon the requirements of the connector assembly and the configuration of the grounding conductors. Additionally, the configuration of grounding conductors themselves may vary widely. For instance, as previously mentioned, a brush arrangement may be used as grounding conductors.

Grounding conductors have generally been described as an array of metallized conductors. The configuration of grounding conductors, however, may vary widely. For example, grounding conductors may include a conductive brush that contacts a cable when the cable is being plugged into a connector. In general, a grounding element that is arranged to prevent ESD events may be substantially any element of an RJ connector assembly that makes contact with electrical contacts of a cable before the cable is seated within the connector assembly without departing from the spirit or the scope of the present invention.

Further, grounding conductors or discharge contacts may be integrated into a connector shell design. That is, instead of being referenced to a grounding shield of a connector, grounding conductors may instead be integrally formed as a part of a grounding shield of the connector. For instance, a grounding shield may be formed such that the grounding shield itself comes into substantially direct contact with the contacts of a cable assembly to provide a ground path for ESD.

It should be appreciated that although a process of inserting a cable assembly into a connector has generally been described as including an ESD event, a process of disengaging or otherwise unmating a cable assembly from a connector may also include an ESD event. In other words, while ground conductors on a connector allow contacts of a cable assembly to discharge accumulated charge upon insertion of the cable assembly into the connector, such ground conductors may also allow accumulated charge on the cable assembly to be discharge upon removing the cable assembly from the connector.

The steps associated with the methods of the present invention may vary widely. Steps may be added, removed, altered, combined, and reordered without departing from the spirit of the scope of the present invention. Therefore, the present examples are to be considered as illustrative and not restrictive, and the invention is not to be limited to the details given herein, but may be modified within the scope of the appended claims.

What is claimed is:

1. An apparatus comprising:

at least one signal contact, the at least one signal contact being an electrical signal contact;

a housing, the housing being arranged to define a receptacle configured to receive a part of a cable assembly, the at least one signal contact being disposed within the receptacle, wherein the at least one signal contact is configured to contact a first contact of the cable assembly when the cable assembly is received in the receptacle such that a signal may pass between the at least one signal contact and the first contact; and a ground arrangement, the ground arrangement being at least partially disposed on the housing and at least partially disposed in the receptacle, wherein the ground arrangement is arranged to contact and to ground the first contact before the first contact contacts the at least one signal contact, the ground arrangement being arranged to include at least one conductor, the at least one conductor being configured to contact and to ground the first contact before the first contact contacts the at least one signal contact, the at least one signal contact being arranged not to ground the first contact, wherein the housing includes a first portion and a second portion, the first portion being removably coupled to the second portion, the first portion being associated with the at least one signal contact and the second portion being associated with the at least one conductor.

2. The apparatus of claim 1 wherein the first portion is associated with a RJ style connector.

3. The apparatus of claim 1 wherein the ground arrangement includes a path to a ground for an electrostatic discharge (ESD) associated with the cable assembly.

4. The apparatus of claim 1 wherein the apparatus is an RJ style connector.

5. A connector assembly comprising:

a housing, the housing being arranged to define a receptacle, wherein the housing includes a front edge that at least partially defines an entrance to the receptacle, the housing further including an RJ style connector and an adapter arranged to be coupled to the RJ style connector;

a grounding shield, the grounding shield being coupled to the housing;

a plurality of contacts, the plurality of contacts being disposed within the receptacle and arranged to receive at least one signal, wherein the plurality of contacts are electrical signal contacts and the plurality of contacts is not communicably coupled to the grounding shield, and wherein the plurality of contacts are disposed within a portion of the receptacle associated with the RJ style connector; and at least one ground conductor, the at least one ground conductor being coupled to the grounding shield, wherein the at least one ground conductor is disposed on the front edge at the entrance to the receptacle, the front edge being associated with the RJ style connector.

6. The apparatus of claim 5 wherein the at least one ground conductor is arranged to prevent electrostatic discharge into the plurality of contacts.

* * * * *